United States Patent [19]

Tabereaux et al.

[11] 4,436,598

[45] Mar. 13, 1984

[54] ALUMINA REDUCTION CELL

[75] Inventors: Alton T. Tabereaux, Sheffield; John T. Willett, Florence, both of Ala.

[73] Assignee: Reynolds Metals Company, Richmond, Va.

[21] Appl. No.: 536,710

[22] Filed: Sep. 28, 1983

[51] Int. Cl.[3] ..... C25C 3/06

[52] U.S. Cl. ..... 204/67; 204/64 R; 204/64 T; 204/65; 204/68; 204/70; 204/243 R; 204/243 M

[58] Field of Search ..... 204/67, 64 R, 64 T, 204/65, 68, 70, 243 R, 243 M

[56] References Cited

U.S. PATENT DOCUMENTS

| | | | |
|---|---|---|---|
| 2,774,804 | 12/1956 | Dow et al. | 204/67 |
| 3,020,220 | 2/1962 | Helling et al. | 204/67 |
| 3,434,957 | 3/1969 | Johnson | 204/67 |
| 3,434,958 | 3/1969 | Johnson | 204/67 |
| 3,438,876 | 4/1969 | Marshall | 204/67 |
| 3,787,300 | 1/1974 | Johnson | 204/67 |
| 4,181,583 | 1/1980 | Steiger et al. | 204/67 |
| 4,247,381 | 1/1981 | Schirnig et al. | 204/67 |
| 4,265,717 | 5/1981 | Wiltzius | 204/67 |

*Primary Examiner*—Arthur P. Demers
*Attorney, Agent, or Firm*—Alan T. McDonald

[57] ABSTRACT

An improved alumina reduction cell is described in which the carbonaceous cathode includes refractory hard metal tiles projecting upwardly from the cell surface thereof, forming the true cathode surface, and inert refractory anode stops protecting the tiles from accidental contact by the anode. These anode stops protect the refractory hard metal shapes from breakage, increasing the useful life of the cell.

9 Claims, 1 Drawing Figure

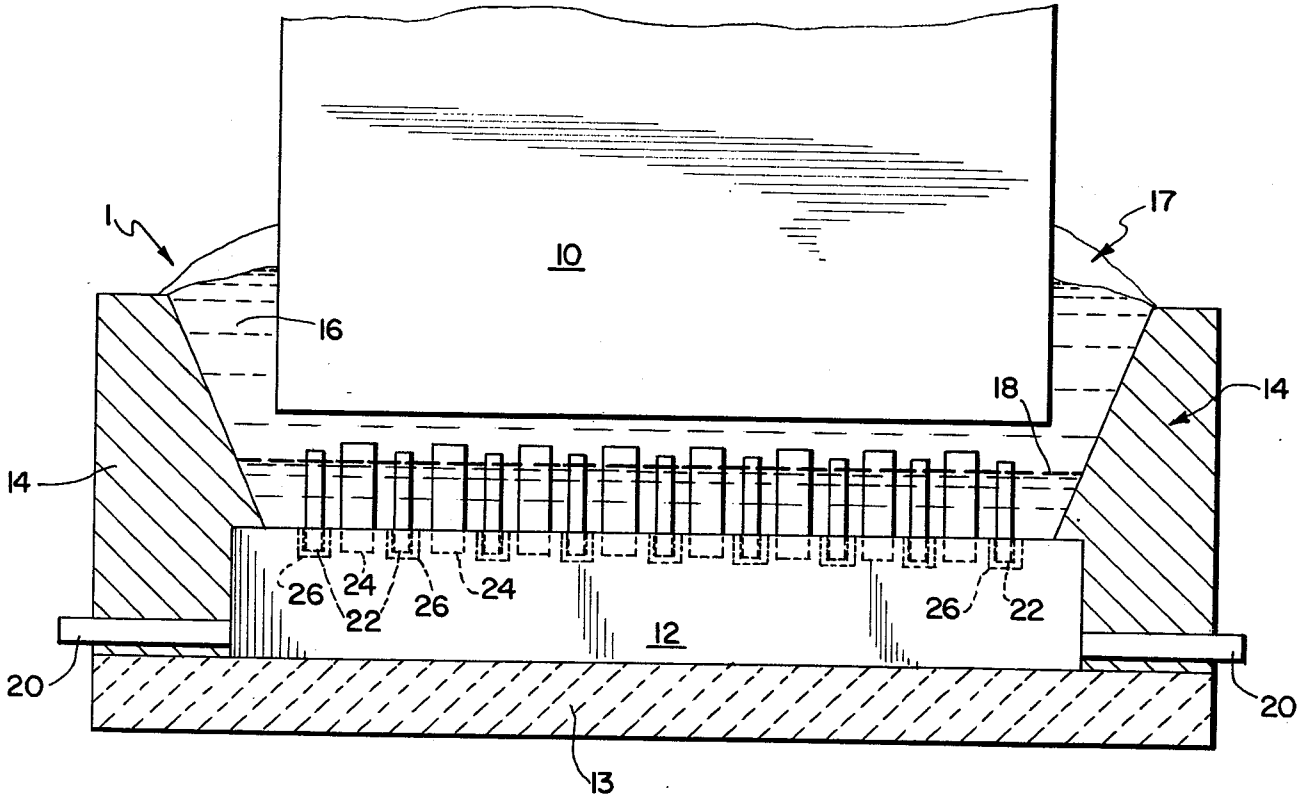
14
20
17
18
22
26
10
12
13
24
26
24
22
26
16
15
14
20

ALUMINA REDUCTION CELL

BACKGROUND OF THE INVENTION

Aluminum metal is conventionally produced by the electrolytic reduction of alumina dissolved in a molten cryolite bath according to Hall-Heroult process.

This process for reducing alumina is carried out in a thermally insulated cell or "pot" which contains the alumina-cryolite bath. The cell floor, typically made of a carbonaceous material, overlies some of the thermal insulation for the cell and serves as a part of the cathode. The cell floor may be made up of a number of carbonaceous blocks bonded together with a carbonaceous cement, or it may be formed using a rammed mixture of finely ground carbonaceous material and pitch. The anode, which usually comprises one or more carbonaceous blocks, is suspended above the cell floor. Resting on the cell floor is a layer or "pad" of molten aluminum which the bath sees as the true cathode. The anode, which projects down into the bath, is normally spaced from the pad at a distance of about 1.5 to 3.0 inches (3.81 to 7.61 centimeters). The alumina-cryolite bath is maintained on top of the pad at a depth of about 6.0 to 12.0 inches (15.24 to 30.48 centimeters).

As the bath is traversed by electric current, alumina is reduced to aluminum at the cathode and carbon is oxidized to its dioxide at the anode. The aluminum thus produced is deposited on the pad and tapped off periodically after it has accumulated.

For the electrolytic process to proceed efficiently, the alumina reduction should occur onto a cathode surface of aluminum and not the bare carbonaceous surface of the cell floor. Therefore, it is considered important for the pad to cover the cell floor completely.

As molten aluminum does not readily wet or spread thinly on carbonaceous materials, the pad can best be visualized as a massive globule on the cell floor. In larger cells, the dense currents of electrolysis give rise to powerful magnetic fields, sometimes causing the pad to be violently stirred and to be piled up in selected areas within the cell. Therefore, the pad must be thick enough so that its movements do not expose the bare surface of the cell floor. Additionally, the anode must be sufficiently spaced from the pad to avoid short circuiting and to minimize reoxidation of aluminum.

Still, the movements of the paid have adverse effects which cannot always be readily controlled. For a given cell operating with a particular current of electrolysis, there is an ideal working distance between the cathode and the anode for which the process will be most energy efficient. However, the required spacing of the anode due to turbulence of the pad prevents this ideal working distance from being constantly maintained. Further, since the pad is in a state of movement, a variable, nonuniform working distance is presented. This variable interelectrode distance can cause uneven wear or consumption of the anode. Pad turbulence can also cause an increase in back reaction or reoxidation at the anode of cathodic products, which lowers cell efficiency. In addition, pad turbulence leads to accelerated bottom liner distortion and degradation through thermal effects and through penetration by the cryolite and its constituents.

It has been suggested in the literature and prior patents that certain special materials, such as refractory hard metals (RHM), most notably titanium diboride ($TiB_2$) or its homologs, can be used advantageously in forming the cell floor. Further, it has been found that RHM tile materials may be embedded into the cell floor, rising vertically through the molten aluminum layer and into the cryolite-alumina bath, with the uppermost ends of these tiles forming the true cathode. When such a cathode design is employed, precise spacing between the true or active surfaces of the cathode and the anode may be maintained, since such a system is not affected by the ever-moving molten aluminum pad acting as the true cathode surface.

Ideally, in contrast to conventional carbon products, these RHM materials are chemically compatible with the electrolytic bath at the high temperatures of cell operation and are also comparable chemically with molten aluminum.

Furthermore, the special cell floor materials are wetted by molten aluminum. Accordingly, the usual thick metal pad should no longer be required, and molten aluminum may be maintained on the cell floor as a relatively thin layer and commensurate with amounts accumulating between the normal tapping schedule.

With all their benefits, there is a problem associated with the use of RHM tiles in reduction cells. The tiles are extremely brittle, and may be broken by contact with an anode lowered thereupon. Anode movement in a cell occurs quite often during aluminum production, due to the need to change anodes, tap aluminum from the cell or adjust the voltage within the cell. Should these tiles be accidently contacted by a lowered anode, and thus broken, increased down time results, due to the need to again raise the anode and replace the tiles, or, in a more extreme case, drain the cell, replace the tiles and restart the cell.

It is thus a primary object of the present invention to reduce RHM tile breakage by eliminating contact between the tiles and the anode.

THE PRESENT INVENTION

By means of the present invention, this desired objective is obtained. The reduction cell of the present invention includes a plurality of anode stops embedded into the cathode and projecting upwardly through the molten aluminum pad and into the alumina-cryolite bath along with the RHM shapes. These anode stops project further into the alumina-cryolite bath then do the RHM shapes, thus supporting a lowered anode and restricting the anode's downward movement such that the anode cannot contact the RHM shapes. These stops are formed from a refractory material which can withstand both the molten aluminum and the molten alumina-cryolite bath and which is not an electrical conductor.

BRIEF DESCRIPTION OF THE DRAWING

The alumina reduction cell of the present invention will be more fully described with reference to the drawing in which:

The FIGURE is a side elevational view of an alumina reduction cell, with the end wall removed, according to the practice of the present invention.

DETAILED DESCRIPTION OF THE PREFERRED EMBODIMENT

The FIGURE illustrates an alumina reduction cell 1 employing the present invention. Anode blocks 10, formed from a carbonaceous material, are suspended within a bath 16 of alumina dissolved in molten cryolite and are attached to a source of electrical current by means not shown. A crust 17 of frozen cryolite-alumina covers the bath 16. Carbaneceous cathode blocks 12 may be joined together by a rammed mixture of pitch and ground carbanaceous material or by means of a carbonaceous cement, by means well-known to those skilled in the art. These cathode blocks 12 are connected by means of conductor bus bars 20 to the electrical current source to complete the electrical circuit. Outer walls 14 form the side and end supporting structures for the cell 1. The walls 14 may be formed, for example, from graphite blocks held together with a graphitic cement.

The carbonaceous blocks 12 include a plurality of tiles or shapes 22, which tiles project upwardly into the molten cryolite-alumina bath 16 and form the actual cathode surface for the cell 1. The tiles 22 are refractory hard metal (RHM) tiles, which may be formed of such materials as $TiB_2$, $TiB_2$-AlN mixtures, and other similar materials, typically by hot pressing or sintering RHM powders to form the shapes. These refractory hard metal materials are wetted by molten aluminum, where they pass through the molten aluminum layer 18, preventing globules of molten aluminum from forming at the interfaces with the tiles 22 and reducing movement of the molten aluminum pad 18.

To minimize cracking during use of these tiles, due to the brittleness of the RHM materials, the RHM tiles 22 may be reinforced with carbon, graphite or silicon carbide fibers or particles, which are added to the powders forming these tiles 22 prior to hot pressing or sintering. When fibers are employed, the fibers may be random or uniform in length and are oriented in the plane perpendicular to the direction of hot pressing. The fibers or particles act to resist tensile stresses that could result in cracking during use.

The RHM shapes or tiles 22 may be embedded directly into the carbonaceous cathode 12, such as by cementing the shapes 22 into the substrate 12 with a carbonaceous cement, or by forming the carbonaceous substrate 12 with the shapes 22 intergral therein. However, it is preferred that the RHM shapes 22 be isolated from the carbonaceous substrate by means of sleeves 26 formed from inert refractory materials. These sleeves are more fully described in copending U.S. application Ser. No. 536,707 filed Sept. 28, 1983.

Interposed among the refractory hard metal shapes 22 are anode stops 24. These anode stops 24 are embedded into cathode 12, such as by cementing the anode stops 24 into the cathode 12 by means of a carbonaceous cement or by forming the carbonaceous cathode 12 with depressions into which the anode stops 24 may be fitted. Employment of depressions without cementing has the advantage of allowing the anode stops 24 to be hot exchanged during operation of the cell 1, without need to shut down and drain the cell 1.

The anode stops 24 extend through the molten aluminum pad 18 and into the alumina-cryolite bath 16. The anode stops 24 extend farther into the alumina-cryolite bath 16 than do the RHM shapes 22, thus providing a surface against which anode 10 may be supported, should anode 10 be lowered by accident to such a level during an anode movement activity. This effectively prevents contact between the anode 10 and the brittle RHM shapes 22, protecting the RHM shapes 22 from breakage in this manner.

The anode stops 24 are formed from a material which is generally inert to both the molten aluminum layer 18 and the alumina-cryolite bath 16 and which is not a conductor of electricity, such that the RHM shapes 22 remain the true cathode. Suitable materials for the anode stops 24 include silicon nitride, silicon carbide, aluminum nitride and boron nitride. A preferred material for the anode stops 24 is silicon nitride bonded silicon carbide. It should be noted that the sleeves 26 supporting the RHM shapes 22 may be formed from the same materials as the anode stops 24.

It is thus clear that the anode stops 24 effectively protect the RHM shapes 22 during aluminum production. This is in contrast to prior structures, such as those disclosed in U.S. Pat. Nos. 4,181,583 and 4,265,717 where spacers to maintain a spacing between an anode and a cathode are employed during start-up of a cell, but are removed prior to actual aluminum production. In the present invention, the anode stops 24 form a permanent portion of the cell 1.

From the foregoing, it is clear that the present invention provides a simple, yet effective, means for preventing damage to RHM shapes within an alumina reduction cell.

While presently preferred embodiments of the invention have been illustrated and described, it is clear that the invention may be otherwise variously embodied and practiced within the scope of the following claims.

We claim:

1. In an alumina reduction cell having an anode, a carbonaceous cathode and a plurity of refractory hard metal (RHM) shapes mounted in and extending vertically upwardly from said cathode, through a molten aluminum pad and into an alumina-cryolite bath, the improvement comprising inert refractory anode stops mounted in said cathode and extending vertically upwardly from said cathode, through said molten aluminum pad and into said aluminum-cryolite bath for a distance greater than said RHM shapes.

2. The cell of claim 1 wherein said anode stops are formed from a material selected from the group consisting of silicon carbide, silicon nitride, aluminum nitride and boron nitride.

3. The cell of claim 2 wherein said anode stops are formed from silicon nitride bonded silicon carbide.

4. The cell of claim 1 wherein said anode stops are cemented into said cathode by means of a carbonaceous cement.

5. The cell of claim 1 wherein said anode stops are fitted into depressions formed in said cathode.

6. The cell of claim 1 wherein said RHM shapes are formed from a material selected from the group consisting of titanium diboride and titanium diboride-aluminum nitride mixtures.

7. The cell of claim 1 wherein said RHM shapes are fiber reinforced.

8. The cell of claim 1 wherein said RHM shapes are mounted into said cathode by means of inert refractory sleeves.

9. The cell of claim 8 wherein said sleeves are formed from a material selected from the group consisting of silicon carbide, silicon nitride, aluminum nitride and boron nitride.

* * * * *